US010508620B2

(12) United States Patent
Kuboyama et al.

(10) Patent No.: US 10,508,620 B2
(45) Date of Patent: Dec. 17, 2019

(54) EVAPORATED FUEL TREATMENT DEVICE

(71) Applicant: FUTABA INDUSTRIAL CO., LTD., Aichi (JP)

(72) Inventors: Keisuke Kuboyama, Aichi (JP); Koji Iwamoto, Aichi (JP); Takuya Nakagawa, Aichi (JP)

(73) Assignee: FUTABA INDUSTRIAL CO., LTD., Aichi (JP)

( * ) Notice: Subject to any disclaimer, the term of this patent is extended or adjusted under 35 U.S.C. 154(b) by 0 days.

(21) Appl. No.: 15/762,358

(22) PCT Filed: Dec. 16, 2016

(86) PCT No.: PCT/JP2016/087594
§ 371 (c)(1),
(2) Date: Mar. 22, 2018

(87) PCT Pub. No.: WO2017/104816
PCT Pub. Date: Jun. 22, 2017

(65) Prior Publication Data

US 2018/0283322 A1 Oct. 4, 2018

(30) Foreign Application Priority Data

Dec. 17, 2015 (JP) ..... 2015-246276

(51) Int. Cl.
*F02M 25/08* (2006.01)
*F02D 41/00* (2006.01)

(52) U.S. Cl.
CPC ..... *F02M 25/089* (2013.01); *F02M 25/0836* (2013.01); *F02D 41/003* (2013.01)

(58) Field of Classification Search
CPC ..... F02M 25/089; F02M 25/0836; F02M 25/0854; F02M 25/0872; F02D 41/003
See application file for complete search history.

(56) References Cited

U.S. PATENT DOCUMENTS 4,951,643 A * 8/1990 Sato ..... F02M 25/0836 123/519
6,279,548 B1 * 8/2001 Reddy ..... B01D 53/02 123/519

(Continued)

FOREIGN PATENT DOCUMENTS

CN 103573479 A 2/2014
JP 2002030998 A 1/2002

(Continued)

OTHER PUBLICATIONS

English translation of the Notification of Reasons for Refusal dated Jul. 3, 2018 for corresponding Japanese Application No. 2015/246276

(Continued)

*Primary Examiner* — Hung Q Nguyen
*Assistant Examiner* — Brian P Monahon
(74) *Attorney, Agent, or Firm* — David D. Brush; Westman, Champlin & Koehler, P.A.

(57) ABSTRACT

An evaporated fuel treatment device is provided in a canister including first to third chambers. The first chamber is provided with an inflow port and an outflow port at an end part thereof, and is connected to the second chamber. The evaporated fuel treatment device is configured as the third chamber of the canister. The third chamber has disposed therein activated carbon as an adsorbent material. The side connected to the second chamber in the third chamber is defined as second chamber side, and the side opposite to the second chamber side is defined as atmosphere side. An atmosphere port is provided at an end part on the atmosphere side of the third chamber. The third chamber is provided with a highly adsorptive layer and a low adsorptive layer which are aligned from the second chamber side to the atmosphere side.

12 Claims, 3 Drawing Sheets

(56) References Cited

U.S. PATENT DOCUMENTS 7,047,952 B1 * 5/2006 Yamauchi ..... B01D 53/0415 123/519
7,134,426 B2 * 11/2006 Uchino ..... F02M 25/0854 123/518
7,294,179 B2 * 11/2007 Kim ..... B01D 53/0415 123/519
7,322,343 B2 * 1/2008 Yamada ..... B60K 15/03504 123/519
9,328,700 B2 * 5/2016 Mani ..... F02M 25/0854
9,422,894 B2 * 8/2016 Akiyama ..... F02M 25/0854
9,482,190 B2 * 11/2016 Makino ..... F02M 25/0854
10,155,191 B2 * 12/2018 Kishida ..... B01D 53/0415
2001/0015134 A1 * 8/2001 Uchino ..... B01D 53/0415 96/130
2002/0020398 A1 * 2/2002 Kimoto ..... F02M 25/0854 123/519
2004/0031469 A1 * 2/2004 Reddy ..... B01D 53/02 123/519
2004/0083894 A1 5/2004 Koyama et al.
2005/0217645 A1 * 10/2005 Fukaya ..... F02M 25/0854 123/519
2006/0283427 A1 * 12/2006 Koyama ..... F02D 41/0042 123/519
2006/0288872 A1 * 12/2006 Nakano ..... B01D 53/02 96/108
2007/0266997 A1 * 11/2007 Clontz, Jr. ..... B01D 53/0438 123/519
2008/0184973 A1 * 8/2008 Yamazaki ..... B01D 53/0415 123/519
2008/0308073 A1 * 12/2008 Allen ..... F02M 25/0854 123/519
2009/0107472 A1 * 4/2009 Makino ..... F02M 25/0836 123/520
2010/0095938 A1 * 4/2010 Kosugi ..... B60K 15/03504 123/519
2011/0315126 A1 * 12/2011 Yoshida ..... F02M 25/0854 123/519
2012/0234301 A1 * 9/2012 Takamatsu ..... F02M 25/0854 123/519
2012/0304865 A1 * 12/2012 Sugiura ..... F02M 25/0854 96/131
2013/0160651 A1 * 6/2013 Mani ..... F02M 35/0218 96/132
2013/0183207 A1 * 7/2013 Kimoto ..... B01D 53/02 422/255
2014/0041522 A1 2/2014 Yoshida et al.
2014/0060499 A1 * 3/2014 Akiyama ..... B01D 53/0407 123/520
2015/0007799 A1 * 1/2015 Takeshita ..... F02M 25/0854 123/519
2015/0275727 A1 * 10/2015 Hiltzik ..... B01D 53/0415 123/519
2016/0271555 A1 * 9/2016 Hiltzik ..... F02M 25/0854
2017/0350352 A1 * 12/2017 Ishikawa ..... B01D 53/04

FOREIGN PATENT DOCUMENTS

JP 2002235610 A * 8/2002
JP 2002235610 A 8/2002
JP 2003003914 A 1/2003
JP 2004143950 A 5/2004
JP 2009250059 A 10/2009
JP 2012007501 A 1/2012
JP 201434909 A 2/2014

OTHER PUBLICATIONS

International Search Report dated Feb. 24, 2017 for corresponding International Application No. PCT/JP2016/087594, filed Dec. 16, 2016.
Written Opinion of the International Searching Authority dated Feb. 24, 2017 for corresponding International Application No. PCT/JP2016/087594, filed Dec. 16, 2016.
International Preliminary Report on Patentability and English translation of the Written Opinion of the International Searching Authority dated Feb. 24, 2017 for corresponding International Application No. PCT/JP2016/087594, filed Dec. 16, 2016.
English translation of the Notification of Reasons for Refusal dated Jul. 30, 2018 for corresponding Japanese Application No. 2015/246276.
Japanese Decision of Refusal dated Nov. 20, 2018 for the corresponding Japanese patent application No. 2015-246276.
English translation of the Office Action dated Jul. 3, 2019 for corresponding Chinese Patent Application No. 201680052936.6.

* cited by examiner

EVAPORATED FUEL TREATMENT DEVICE

CROSS-REFERENCE TO RELATED APPLICATION

This Application is a Section 371 National Stage Application of International Application No. PCT/JP2016/087594, filed Dec. 16, 2016, and published as WO 2017/104816 A1, on Jun. 22, 2017, and claims priority to and is based on Japanese Patent Application No. 2015-246276 filed with the Japan Patent Office on Dec. 17, 2015, and the entire contents of which are incorporated herein by reference in their entireties.

TECHNICAL FIELD

The present disclosure relates to an evaporated fuel treatment device which ensures adsorption of fuel vapor generated from a fuel tank.

BACKGROUND ART

A canister comprising first to third chambers in which an adsorbent material such as activated carbon is disposed is known. The first chamber is provided with an inflow port connected to a fuel tank and an outflow port connected to an internal combustion engine. Fuel vapor flowing in from the inflow port is adsorbed on adsorbent materials in the respective chambers. The third chamber is provided with an atmosphere port. At the time of purging, air (hereinafter referred to as "purge air") flows in from the external of a vehicle via the atmosphere port. The fuel adsorbed on the adsorbent materials in the respective chambers is removed by the purge air, and flows out from the outflow port toward the internal combustion engine.

Patent Document 1 describes that activated carbon having high performance of desorbing the adsorbed fuel (hereinafter referred to as "low adsorptive carbon") is disposed in a third chamber of a canister. This enables sufficient removal of the fuel adsorbed on the activated carbon in the third chamber even when the amount of purge air is small at the time of purging.

On the other hand, Patent Document 2 describes that activated carbon having a large adsorption capacity (hereinafter referred to as "highly adsorptive carbon") is disposed in a third chamber of a canister. This can suppress migration which is a phenomenon that the fuel accumulated inside moves toward an atmosphere port and flows out from the atmosphere port when the canister is left as it is over a long term.

PRIOR ART DOCUMENTS

Patent Documents

Patent Document 1: JP 2009-250059 A
Patent Document 2: JP 2012-7501 A

SUMMARY OF THE INVENTION

Problems to be Solved by the Invention

In recent years, however, the amount of purge air is decreasing due to hybridization and the like of vehicles. However, the technique of Patent Document 2 requires more purge air to sufficiently remove fuel by purging because the highly adsorptive carbon in the third chamber has low desorbing performance.

On the other hand, the technique of Patent Document 1 enables sufficient removal of fuel with a small amount of purge air, as mentioned above. In order to accumulate a sufficient amount of fuel vapor in the third chamber, however, it is necessary to increase L/D of the third chamber and to dispose a large amount of low adsorptive carbon in the third chamber. Meanwhile, L/D is a value obtained by dividing L which represents the length of a chamber by D which represents the width of the chamber. As a result, the ventilation resistance, when the air flowing in from the fuel tank at the time of oil supply passes through the canister, increases.

Further, it is also conceivable to solidify activated carbon with a binder and to dispose, in the third chamber, a honeycomb adsorbent material formed into a cylindrical member having a honeycomb structure. The honeycomb adsorbent material has excellent performance of desorbing the adsorbed fuel, and thus can remove the fuel accumulated in the third chamber with a small amount of purge air. However, the use of the honeycomb adsorbent material increases the cost.

In one aspect of this disclosure, it is desirable to suppress the outflow of fuel vapor into the atmosphere under a circumstance where the amount of purge air is small, at a low cost.

Means for Solving the Problems

One aspect of this disclosure is an evaporated fuel treatment device which is provided in a canister. The canister comprises an inflow port, an outflow port and an atmosphere port, accumulates fuel vapor flowing in from a fuel tank via the inflow port, and causes the accumulated fuel vapor to flow out to an internal combustion engine via the outflow port by air flowing in from the atmosphere port. The canister further comprises a first chamber and a second chamber. The first chamber has a first space which has disposed therein a first adsorbent material that is an adsorbent material for adsorbing the fuel vapor, and an end part on one side in the first space is connected to an external space through the inflow port and the outflow port. The second chamber has a second space which is connected to an end part on the other side positioned opposite to the one side in the first space, extends from the other side to the one side, and has disposed therein a second adsorbent material that is the adsorbent material.

The evaporated fuel treatment device is configured as a third chamber having a third space which has disposed therein activated carbon for adsorbing fuel vapor and is connected to an end part on one side of the second space. Here, the side on which a part connected to the second space is positioned, in the third space, is defined as "second chamber side," and the side positioned opposite to the second chamber side is defined as "atmosphere side." The end part on the atmosphere side in the third space is connected to the external via the atmosphere port, and the third space is provided with a highly adsorptive layer and a low adsorptive layer which are aligned from the second chamber side to the atmosphere side. The highly adsorptive layer and the low adsorptive layer each have the activated carbon disposed therein, and the highly adsorptive layer has stronger power for adsorbing the fuel vapor than that of the low adsorptive layer, and is positioned on the second chamber side as compared with the low adsorptive layer.

By virtue of such a configuration, a large amount of the fuel moving to the atmosphere port by migration can be adsorbed on the highly adsorptive layer disposed on the second chamber side of the third chamber (in other words, evaporated fuel treatment device). This makes it possible to keep a large amount of fuel at a position distant from the atmosphere port. As a result, the movement of fuel to the atmosphere port by migration can be delayed. Therefore, it is possible to suppress the outflow of fuel vapor from the atmosphere port.

Also, in addition to the highly adsorptive layer, the low adsorptive layer which ensures easy removal of the adsorbed fuel is disposed in the third chamber. Therefore, the fuel accumulated in the third chamber is easily removed by purging, as compared with when only activated carbon having strong adsorption power is disposed in the third chamber. Therefore, the fuel accumulated in the third chamber can be sufficiently removed even when the amount of purge air is small.

Such easy removal of fuel by purging results in decrease in fuel remaining in the third chamber. Therefore, the amount of activated carbon in the third chamber can be reduced. This makes it further easier to remove the fuel accumulated in the respective chambers of the canister by purging.

Further, the above configuration sufficiently suppresses the outflow of fuel vapor by migration and realizes effective removal of the accumulated fuel by purging, due to the use of activated carbon as an adsorbent material. Therefore, the necessity to use a honeycomb adsorbent material as the adsorbent material for fuel is reduced.

Accordingly, it is possible to suppress the outflow of fuel vapor into the atmosphere under a circumstance where the amount of purge air is small, at a low cost.

Also, in an evaporated fuel treatment device according to one aspect of this disclosure, in the third space, a honeycomb adsorbent which is a cylindrical member with a honeycomb structure that can adsorb and desorb the fuel vapor may further be disposed on the atmosphere side as compared with the low adsorptive layer.

The honeycomb adsorbent ensures easy removal of the adsorbed fuel. Therefore, such a configuration can increase the amount of the fuel accumulated in the third chamber while making it possible to sufficiently remove the accumulated fuel by purging with a small amount of purge air. This can further suppress the outflow of fuel vapor from the atmosphere port.

Since the third chamber is provided with a highly adsorptive layer and a low adsorptive layer, it is possible to suppress the outflow of fuel vapor from the atmosphere port. Therefore, it is possible to sufficiently suppress the outflow of fuel vapor from the atmosphere port even when the honeycomb adsorbent is small.

Accordingly, it is possible to further suppress the outflow of fuel vapor under a circumstance where the amount of purge air is small, while saving the cost.

EXPLANATION OF REFERENCE NUMERALS

1 . . . canister, 10 . . . container, 11 . . . inflow port, 12 . . . outflow port, 13 . . . atmosphere port, 20 . . . first chamber, 30 . . . second chamber, 40 . . . third chamber, 44 . . . highly adsorptive layer, 45 . . . low adsorptive layer, 50 . . . third chamber, 54 . . . highly adsorptive layer, 55 . . . low adsorptive layer, 60 . . . third chamber, 64 . . . first adsorptive layer, 65 . . . second adsorptive layer, 66 . . . third adsorptive layer, 100 . . . canister, 110 . . . first container, 111 . . . inflow port, 112 . . . outflow port, 120 . . . first chamber, 130 . . . second chamber, 140 . . . third chamber, 141 . . . highly adsorptive layer, 142 . . . low adsorptive layer, 143 . . . second container, 144 . . . atmosphere port Mode for Carrying Out the Invention Hereinafter, embodiments of the present disclosure will be described with reference to the drawings. The embodiments of the present disclosure are not limited to the following embodiments, and can include various forms as long as the embodiments pertain to the technical scope of the present disclosure.

[First Embodiment]

[Explanation of Configuration]

Figure 1A:
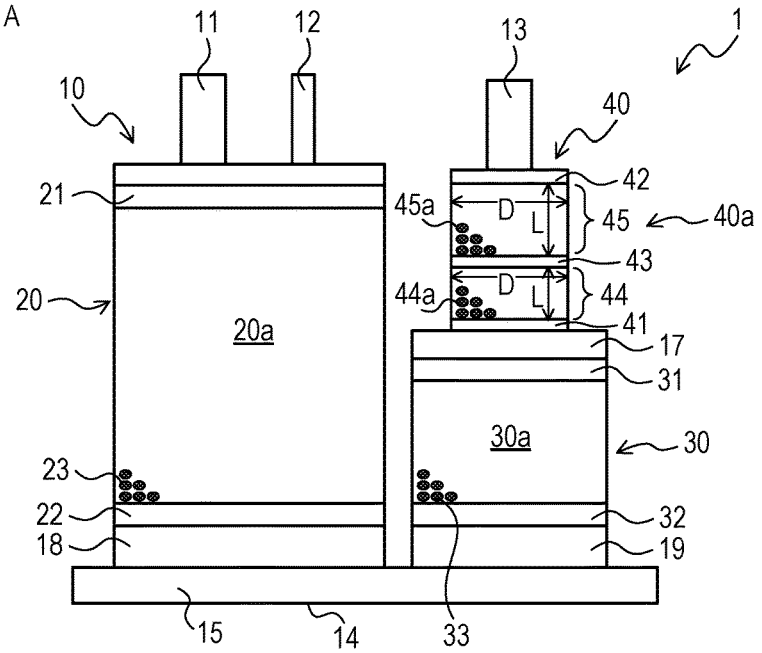
FIG. 1A is an explanatory view schematically showing the internal structure of a canister according to a first embodiment as a cross section.

As shown in FIG. 1A, a canister 1 according to a first embodiment has a container 10 made of a synthetic resin and having an approximately rectangular parallelepiped shape. The canister 1 has first to third chambers 20 to 40. First to third spaces 20*a* to 40*a* are provided within the first to third chambers 20 to 40, respectively. These spaces are provided within the container 10. Activated carbon for adsorbing fuel vapor is disposed in these spaces.

An inflow port 11, an outflow port 12 and an atmosphere port 13 are provided at an end part on one side of the container 10. The inflow port 11 and the outflow port 12 connect the first space 20*a* of the first chamber 20 and the external space. The atmosphere port 13 connects the third space 40*a* of the third chamber 40 and the external space.

The inflow port 11 is connected, via a valve, to a fuel tank of one's own vehicle equipped with the canister 1. The fuel vapor generated from the fuel accumulated in the fuel tank, when flowing into the canister 1 via the inflow port 11, is adsorbed on activated carbon disposed in each of the chambers. Thus, fuel is accumulated within the canister 1.

The outflow port 12 is connected to an intake pipe of an internal combustion engine of the one's own vehicle via a valve. The atmosphere port 13 is connected to the external of the one's own vehicle. Air in the atmosphere (hereinafter referred to as "purge air") flows into the canister 1 via the atmosphere port 13 due to the intake negative pressure of the internal combustion engine. At this time, the fuel adsorbed on the activated carbon is desorbed by the purge air, and is caused to flow out toward the intake pipe via the outflow port 12. This results in removal of the fuel adsorbed on the activated carbon and results in regeneration of the activated carbon. Hereinafter, such regeneration of the activated carbon is referred to as "purging."

Next, the configuration of the canister 1 will be described in detail. Hereinafter, the side on which the inflow port 11 and the like are provided, in the container 10 of the canister 1, is referred to as "the one side," and the side positioned opposite to the one side is referred to as "the other side." The container 10 has an opening on the other side. The opening is closed by a lid member 14.

The first chamber 20 and first space 20*a* are in an approximately rectangular parallelepiped shape. A filter 21 is disposed at an end part on the one side in the first space 20*a*. Also, the first space 20*a* is connected to a communication passage 15 at an end part on the other side thereof. The communication passage 15 is a space disposed along the lid member 14. The communication passage 15 connects the first space 20*a* and the second space 30*a*. A filter 22 is disposed at the end part on the other side in the first space 20*a*. The volume of the first space 20*a* is larger than the sum of the volumes of the second and third spaces 30*a*, 40*a*.

The second chamber 30 and second space 30*a* and the third chamber 40 and third space 40*a* are disposed adjacent to the first chamber 20. These chambers and spaces extend from the other side to the one side. The second and third chambers 30, 40 are aligned from the other side to the one side of the first chamber 20 in a state where their end parts are adjacent to each other.

The second space 30*a* and the third space 40*a* are isolated by a plate-like partition member 17 having permeability. The partition member 17 may be composed of a porous plate or the like. That is, the fluid accumulated within the canister 1 can travel between these spaces through the partition member 17. In other words, the end part on the one side of the second space 30*a* and the end part on the other side of the third space 40*a* are connected to each other.

The second space 30*a* is connected to the aforementioned communication passage 15 at the end part on the other side thereof, and connected to the first space 20*a* via the communication passage 15. A filter 32 is disposed at the end part on the other side of the second space 30*a*. A filter 31 is disposed at the end part on the one side of the second space 30*a*.

The third space 40*a* is connected to the atmosphere port 13 at the end part on the one side thereof. The third space 40*a* is a slender space having a constant width. In the first embodiment, the third space 40*a* is in a columnar shape. The third space 40*a*, however, may be in a polygonal prism shape. A filter 41 is disposed at the end part on the other side in the third space 40*a*. A filter 42 is disposed at the end part on the one side in the third space 40*a*.

Porous plates 18, 19 having permeability are disposed adjacent to a lid member side of the filters 22, 32, respectively, disposed between the first space 20*a* and second space 30*a* and the communication passage 15. Coil springs (not shown) are disposed between the respective porous plates and the lid member 14, and push these porous plates 18, 19 toward the one side.

Therefore, the fluid accumulated within the canister 1 can travel between the first and second spaces 20*a*, 30*a* and the communication passage 15 through the porous plates 18, 19. Therefore, the fluid can travel between the first and second spaces 20*a*, 30*a*. In other words, the end part on the other side of the first space 20*a* and the end part on the other side of the second space 30*a* are connected to each other.

First and second activated carbons 23, 33 are disposed in the first and second spaces 20*a*, 30*a*, respectively, in a state where the activated carbons are each held between the filter on the one side and the filter on the other side.

On the other hand, activated carbon is disposed in the third space 40*a* in a state where the third space has a highly adsorptive layer 44 and a low adsorptive layer 45. Hereinafter, the side on which a part connected to the second space 30*a* is positioned in the third space 40*a* (in other words, the other side) is referred to as "second chamber side." The side positioned opposite to the second chamber side in the third space 40*a* (in other words, the one side) is referred to as "atmosphere side."

The highly adsorptive layer 44 and the low adsorptive layer 45 are aligned from the second chamber side to the atmosphere side. The highly adsorptive layer 44 is positioned on the second chamber side as compared with the low adsorptive layer 45. Therefore, the highly adsorptive layer 44 is positioned on the atmosphere side of the filter 41. The low adsorptive layer 45 is positioned on the second chamber side of the filter 42. A filter 43 is disposed between these layers. However, the present invention is not limited to this, and may be configured so that no filter 43 is provided. The present invention may also be configured so that either or both of the filters 41, 42 is/are not provided. Also, members having permeability may be disposed in place of the filters 41 to 43. Also, a gap may be provided between the highly adsorptive layer 44 and the low adsorptive layer 45 and/or between these layers and an end part of the third space 40*a*.

The activated carbon disposed in the highly adsorptive layer 44 (hereinafter referred to as "highly adsorptive carbon 44*a*") has stronger power for adsorbing fuel vapor than that of the activated carbon disposed in the low adsorptive layer 45 (hereinafter referred to as "low adsorptive carbon 45*a*"). In other words, the highly adsorptive carbon 44*a* has a larger adsorption capacity than that of the low adsorptive carbon 45*a*. The adsorption capacity means butane working capacity (i.e., BWC) as defined by ASTM 5228. That is, the adsorption power of the highly adsorptive layer 44 as a whole is stronger than that of the low adsorptive layer 45 as a whole.

Here, the direction from the second chamber side toward the atmosphere side in the third space 40*a* is referred to as "third chamber direction." The length of the third chamber direction in the third space 40*a* is designated as L. The length of a direction orthogonal to the third chamber direction in the third space 40*a* (in other words, width) is designated as D. D corresponds to the diameter of the circular cross section of the columnar third space 40*a*. D may be smaller than the width of the second space 30*a* of the second chamber 30.

L of the highly adsorptive layer 44 may be shorter than L of the low adsorptive layer 45. Also, L/D of the highly adsorptive layer 44 and L/D of the low adsorptive layer 45 may be less than 1. Of course, the present invention is not limited to this, and L of the highly adsorptive layer 44 may be longer than L of the low adsorptive layer 45. Also, either or both of L/D of the highly adsorptive layer 44 and L/D of the low adsorptive layer 45 may be 1 or more.

The amount of purge air flowing in from the atmosphere port 13 by purging is defined as purge flow rate. For example, the L and D values of the respective layers, L/D, the ratio among the L values of the respective layers, and the kinds of the activated carbons in the respective layers are selected so that the fuel adsorbed on the activated carbon disposed in the third space 40*a* is sufficiently removed by inflow, from the atmosphere port 13, of purge air at a purge flow rate as defined according to the type of one's own vehicle.

Specifically, activated carbon selected from, for example, those having an adsorption capacity of 17 g/dL, 15 g/dL, 11 g/dL, 9 g/dL or 7 g/dL may be arranged in each of the layers. Specific examples of such activated carbon can include activated carbons manufactured by MeadWestvaco Corporation, BAX1700, BAX1500, BAX1100 and BAX LBE.

[Advantageous Effect]

According to the first embodiment, a large amount of fuel moving to the atmosphere port 13 by migration can be adsorbed on the highly adsorptive layer 44 disposed on the second chamber side of the third chamber 40. This makes it possible to keep a large amount of fuel at a position distant from the atmosphere port 13. As a result, the movement of fuel to the atmosphere port 13 by migration can be delayed. Therefore, it is possible to suppress the outflow of fuel vapor from the atmosphere port 13.

Also, in addition to the highly adsorptive layer 44, the low adsorptive layer 45 is disposed in the third chamber 40. Therefore, the fuel accumulated in the third chamber 40 is easily removed by purging, as compared with when only activated carbon having strong adsorption power is disposed in the third chamber 40. Therefore, the fuel accumulated in the third chamber 40 can be sufficiently removed even when the amount of the purge air is small.

Such easy removal of fuel by purging results in a decrease in fuel remaining in the third chamber 40. Therefore, the amount of the activated carbon in the third chamber 40 can be reduced. This makes it further easier to remove the fuel accumulated in the respective chambers of the canister 1 by purging.

Further, the above configuration sufficiently suppresses the outflow of fuel vapor by migration and realizes effective removal of the accumulated fuel by purging, due to the use of activated carbon as an adsorbent material. Therefore, the necessity to use a honeycomb adsorbent material as the adsorbent material for fuel becomes low.

Accordingly, it is possible to suppress the outflow of fuel vapor into the atmosphere under a circumstance where the amount of purge air is small, at a low cost.

Further, L/D of the low adsorptive layer 45 and L/D of the highly adsorptive layer 44 are each less than 1. Therefore, it is possible to shorten L of the third chamber 40 while suppressing the lowering in fuel vapor adsorption power of the third chamber 40 as a whole. This makes it possible to surely keep the fuel vapor released from the second chamber 30 in the third chamber 40 and also to remove the fuel adsorbed on the adsorbent material in the third chamber 40 at a low purge flow rate.

Due to low L/D of the third chamber 40, it is possible to suppress the ventilation resistance when the air flowing in from the fuel tank during oil supply passes through the canister 1. Also, due to small L of the third chamber 40, the canister 1 can be reduced in size.

MODIFIED EXAMPLE 1

[Explanation of Configuration]

Next, Modified Example 1 of the canister 1 according to the first embodiment will be described. A canister 1 of Modified Example 1 has the same configuration as that of the canister according to the first embodiment. However, Modified Example 1 is different, in terms of the configuration of a third chamber 50, from the first embodiment. Hereinafter, the difference of Modified Example 1 from the first embodiment will be described.

Figure 1B:
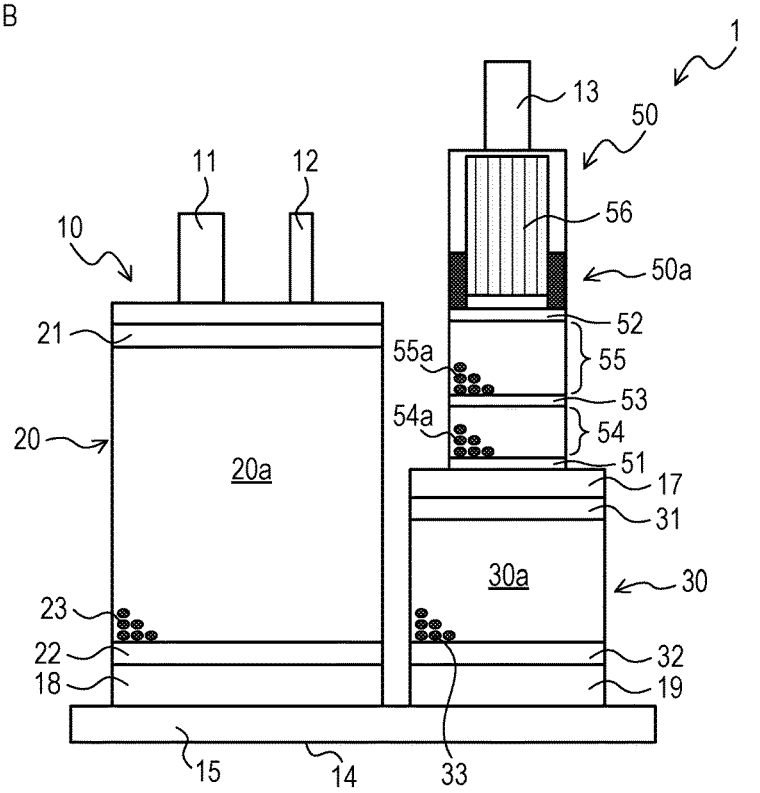
FIG. 1B is an explanatory view schematically showing the internal structure of a canister according to Modified Example 1 of the first embodiment as a cross section.

As shown in FIG. 1B, the third chamber 50 in the canister 1 of Modified Example 1 has a third space 50*a*, as with the first embodiment. The third chamber 50 is disposed in a state where it is adjacent to a first chamber 20. Also, the third chamber 50 and a third space 50*a* extend from the other side to the one side in a state where their end parts are adjacent to an end part on the one side of a second chamber 30, as with the first embodiment. The third space 50*a* is connected to an atmosphere port 13 and a second chamber 30*a*, as with the first embodiment.

In the third space 50*a*, there are disposed filters 51 to 53, highly adsorptive carbon 54*a* and low adsorptive carbon 55*a* in a state where the third space 50*a* has a highly adsorptive layer 54 positioned on the second chamber side and a low adsorptive layer 55 positioned on the atmosphere side, in a similar manner as in the first embodiment. Further, a honeycomb adsorbent 56 is disposed between the low adsorptive layer 55 in the third space 50*a* and the atmosphere port 13.

The honeycomb adsorbent 56 is a cylindrical member with a honeycomb structure which can adsorb and desorb the evaporated fuel. The honeycomb adsorbent 56 is provided with many fluid passages extending from the second chamber side to the atmosphere side. The honeycomb adsorbent 56 is composed of activated carbon. Specifically, the honeycomb adsorbent 56 may be formed by solidifying activated carbon with a binder.

L of the highly adsorptive layer 54, L of the low adsorptive layer 55 and D of the third space 50*a* may be defined in a similar manner as in the first embodiment.

[Advantageous Effect]

The canister 1 of Modified Example 1 provides an advantageous effect similar to that obtained by the first embodiment.

Also, the honeycomb adsorbent 56 ensures easy removal of the adsorbed fuel, and thus can increase the amount of the fuel accumulated in the third chamber 50 while being able to sufficiently remove the accumulated fuel by purging with a small amount of purge air. Therefore, the outflow of fuel vapor from the atmosphere port 13 can be further suppressed.

Since the third chamber 50 is provided with the highly adsorptive layer 54 and the low adsorptive layer 55, it is possible to suppress the outflow of fuel vapor from the atmosphere port 13. Therefore, it is possible to sufficiently suppress the outflow of fuel vapor from the atmosphere port 13 even when the honeycomb adsorbent 56 is small.

Accordingly, it is possible to further suppress the outflow of fuel vapor under a circumstance where the amount of purge air is small, while reducing the cost.

MODIFIED EXAMPLE 2

[Explanation of Configuration]

Next, Modified Example 2 of the canister 1 according to the first embodiment will be described. A canister 1 of Modified Example 2 has the same configuration as that of the canister according to the first embodiment. However, Modified Example 2 is different, in terms of the configuration of a third chamber 60, from the first embodiment. Hereinafter, the difference of Modified Example 2 from the first embodiment will be described.

Figure 2A:
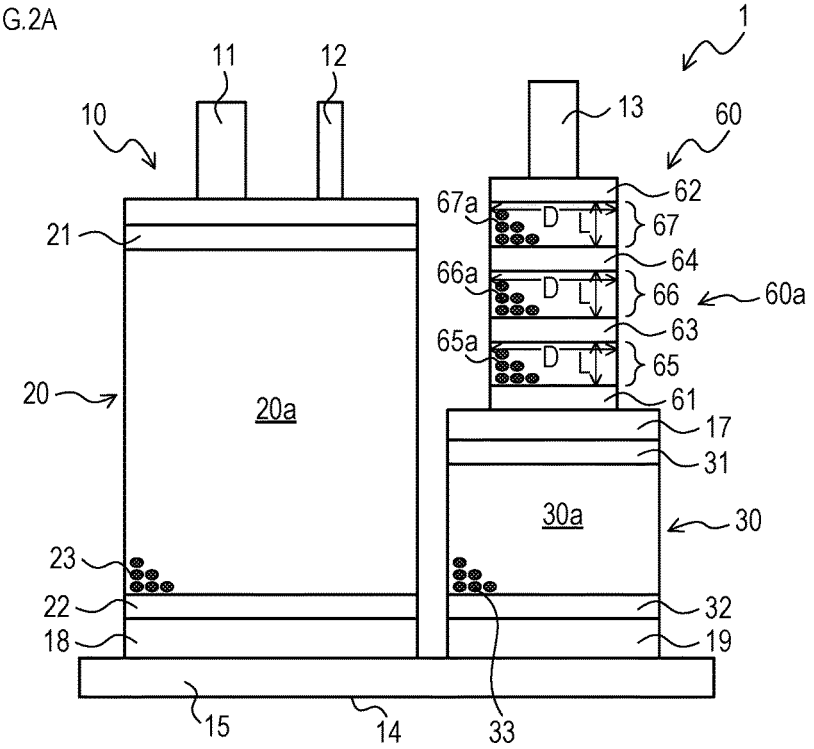
FIG. 2A is an explanatory view schematically showing the internal structure of a canister according to Modified Example 2 of the first embodiment as a cross section.

As shown in FIG. 2A, the third chamber 60 in the canister 1 of Modified Example 2 has a third space 60*a*, as with the first embodiment. The third chamber 60 is disposed in a state where it is adjacent to a first chamber 20. Also, the third chamber 60 and the third space 60*a* extend from the other side to the one side in a state where their end parts are adjacent to an end part on the one side of a second chamber 30, similarly to the first embodiment. The third space 60*a* is connected to an atmosphere port 13 and a second chamber 30*a*, as with the first embodiment.

A filter 61 is disposed at an end part on the second chamber side in the third space 60*a*. A filter 62 is disposed at an end part on the atmosphere side in the third space 60*a*.

Activated carbon is disposed in the third space 60*a* in a state where the third space 60*a* has three layers, i.e., first to third adsorptive layers 65 to 67. These layers are aligned from the second chamber side to the atmosphere side. The first adsorptive layer 65 is positioned nearest to the second chamber side. The third adsorptive layer 67 is positioned nearest to the atmosphere side. A filter 63 is disposed between the first and second adsorptive layers 65, 66, and a filter 64 is disposed between the second and third adsorptive layers 66, 67. However, the present invention is not limited to this, and may be configured so that no filter is provided between the respective layers. Also, a gap may be provided between the respective layers and/or between the first and third adsorptive layers 65, 67 and an end part of the third space 60*a*.

Activated carbons which are different in adsorption power are disposed in the first to third adsorptive layers 65 to 67, respectively. At this time, at least two of these layers are brought in a state where the layer having highly adsorptive carbon disposed therein is positioned on the second chamber side as compared with the layer having low adsorptive carbon disposed therein.

In brief, for example, the first adsorptive layer 65 may serve as a highly adsorptive layer having highly adsorptive carbon disposed therein, and the second adsorptive layer 66 or third adsorptive layer 67 may serve as a low adsorptive layer having low adsorptive carbon disposed therein. Also, for example, the second adsorptive layer 66 may serve as a highly adsorptive layer, and the third adsorptive layer 67 may serve as a low adsorptive layer.

L of the highly adsorptive layer, L of the low adsorptive layer and D of the third space 60*a* may be defined in a similar manner as in the first embodiment.

Four or more layers having disposed therein activated carbons which are different in adsorption power may be provided in the third space 60*a*. For at least two of these layers, the layer which serves as a highly adsorptive layer may be positioned on the second chamber side as compared with the layer which serves as a low adsorptive layer.

[Advantageous Effect]

The canister 1 of Modified Example 2 provides an advantageous effect similar to that obtained by the first embodiment.

MODIFIED EXAMPLE 3

[Explanation of Configuration]

Next, Modified Example 3 of the canister 1 according to the first embodiment will be described. A canister 1 of Modified Example 3 has the same configuration as that of the canister according to the first embodiment. However, Modified Example 3 is different, in terms of the configuration of a second chamber 30, from the first embodiment.

Figure 2B:
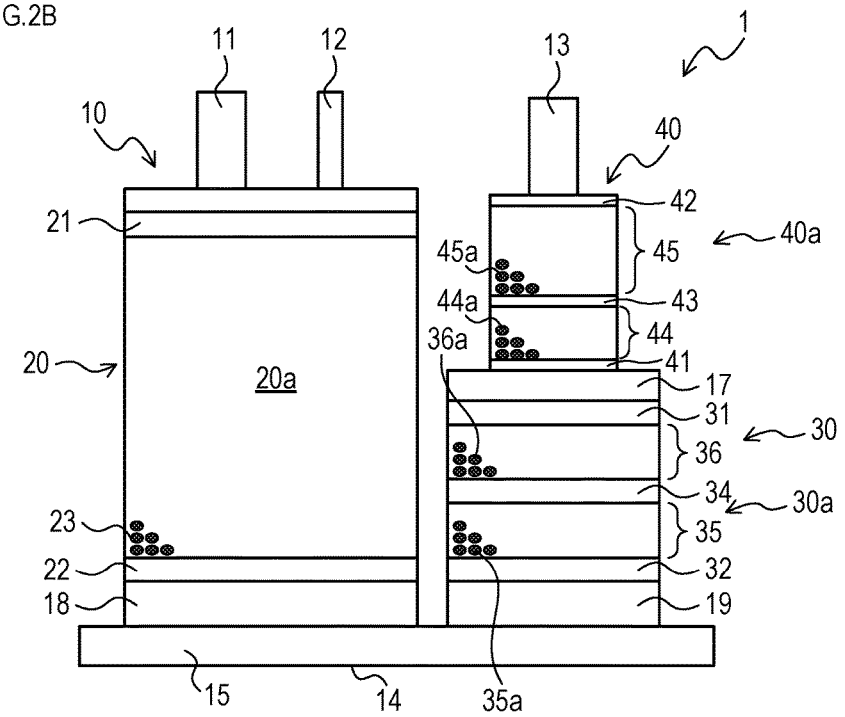
FIG. 2B is an explanatory view schematically showing the internal structure of a canister according to Modified Example 3 of the first embodiment as a cross section.

A second space 30*a* of Modified Example 3 has filters 31, 32 and activated carbon disposed therein, as with the first embodiment. In Modified Example 2, however, activated carbon is disposed in the second space 30*a* in a state where the second space 30*a* has a plurality of layers which are different in adsorption power. These layers are aligned from the other side to the one side. In FIG. 2B, two layers 35, 36 are provided in the second space 30*a*, as one example. The respective layers have disposed therein activated carbons 35*a*, 36*a* which are different in adsorption power. A filter 34 is disposed between these layers 35, 36.

Activated carbon may be similarly disposed also in the first space 20*a* in a state where the first space 20*a* has a plurality of layers which are different in adsorption power.

[Advantageous Effect]

The canister 1 of Modified Example 3 provides an advantageous effect similar to that obtained by the first embodiment.

[Second Embodiment]

[Explanation of Configuration]

Figure 3:
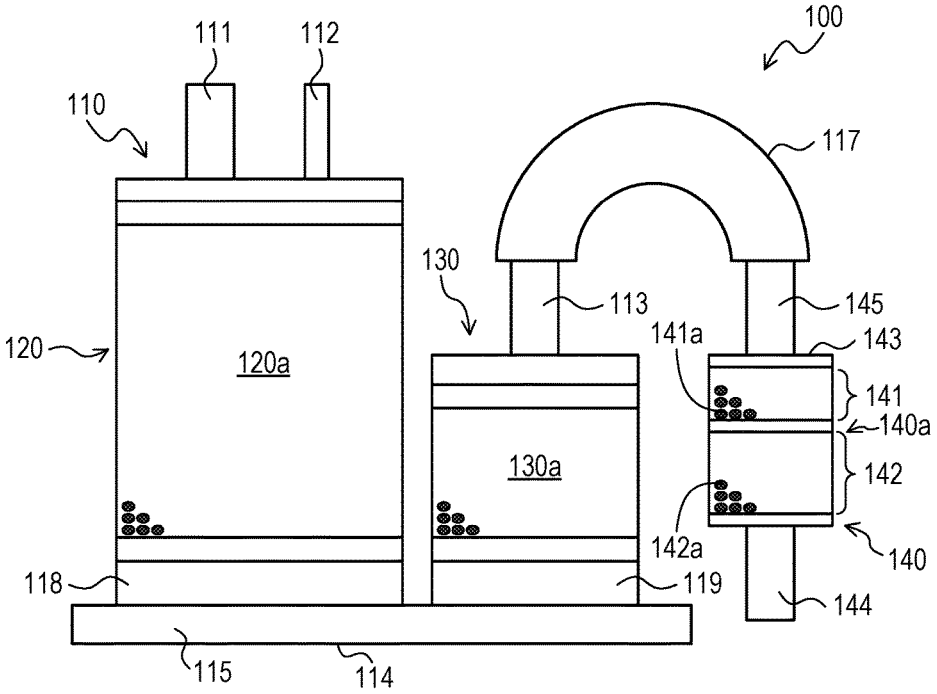
FIG. 3 is an explanatory view schematically showing the internal structure of a canister according to a second embodiment as a cross section.

Next, a canister 100 according to a second embodiment will be described. As shown in FIG. 3, the canister 100 of the second embodiment is provided with an inflow port 111, an outflow port 112, an atmosphere port 144 and first to third chambers 120 to 140, which are similar to those of the first embodiment. The first to third chambers 120 to 140 each have first to third spaces 120*a* to 140*a* which are similar to those of the first embodiment. Activated carbon is disposed in the space of each of the respective chambers, in a similar manner as in the first embodiment. In a similar manner as in the first embodiment, fuel vapor is accumulated inside, and purging is carried out.

However, the canister 1 of the first embodiment comprises the first to third chambers 20 to 40 integrally (in other words, non-separably). Contrary to this, the canister 100 of the second embodiment is brought in a state where the first and second chambers 120, 130 and the third chamber 140 are separated from each other. The canister 100 of the second embodiment is different from that of the first embodiment in this respect. Hereinafter, the difference of this canister from the canister 1 of the first embodiment will be mainly described.

The canister 100 according to the second embodiment has a first container 110 and a second container 143 which are made of a synthetic resin.

The first container 110 is provided with the first and second chambers 120, 130, the inflow port 111 and the outflow port 112. The first chamber 120, inflow port 111 and outflow port 112 are configured in a similar manner as in the first embodiment. The second chamber 130 is disposed adjacent to the first chamber 120, as with the first embodiment. The second chamber 130 extends from an end part on the other side to the one side of the first chamber 120. The first and second spaces 120*a*, 130*a* each have activated carbon and filters disposed therein, in such a manner as in the first and second spaces 20*a*, 30*a* of the first embodiment.

The first container 110 has a communication passage 115, a lid member 114 and porous plates 118, 119 which are similar to those of the first embodiment. The first space 120*a* and the second space 130*a* are connected at an end part on the other end of the first container 110 in a similar manner as in the first embodiment.

A first connection port 113 is provided at an end part on the one side of a part in which the second chamber 130 is provided in the first container 110. The first connection port 113 connects the second space 130*a* and the external space.

On the other hand, the second container 143 is provided with a second connection port 145, the atmosphere port 144 and the third chamber 140. The second connection port 145 is provided at one end of the second container 143. The atmosphere port 144 is provided at the other end of the second container 143. The atmosphere port 144 and the second connection port 145 connect the third space 140*a* and the external space.

The second connection port 145 is connected to the first connection port 113 of the first container 110 by a flexible tube 117. The tube 117 may be made of a synthetic resin or the like. The second space 130*a* and the third space 140*a* are connected to each other by the tube 117.

Here, in the third chamber 140 of the second embodiment, the side on which the second connection port 145 is positioned corresponds to the second chamber side of the first embodiment, and the side on which the atmosphere port 144 is positioned corresponds to the atmosphere side of the first embodiment. The third space 140*a* has activated carbon disposed therein in a state where the third space 140*a* has a highly adsorptive layer 141 and a low adsorptive layer 142 in a similar manner as in the first embodiment. That is, the third space 140*a* has filters, highly adsorptive carbon 141*a* and low adsorptive carbon 142*a* disposed therein in a similar manner as in the first embodiment.

Also in the canister 100 of the second embodiment, fuel is accumulated inside in a similar manner as in the first embodiment. At the time of purging, the purge air flowing into the third chamber 140 through the atmosphere port 144 flows into the second chamber 130 and the first chamber 120 through the second connection port 145, first connection port 113 and tube 117. This results in desorption of the fuel adsorbed on the activated carbon and regeneration of the activated carbon in a similar manner as in the first embodiment.

[Advantageous Effect]

The canister 100 of the second embodiment provides an advantageous effect similar to that obtained by the first embodiment.

In the second embodiment, the first and second chambers 120, 130 and the third chamber 140 are in a separated state. Therefore, the arrangement position of the canister 100 can be more flexibly defined.

[Other Embodiments]

(1) In the third spaces of the third chambers in the canisters according to the first embodiment, Modified Examples 1 to 3 and second embodiment, respectively, activated carbons having the same adsorption power are disposed in each of the high and low adsorptive layers. However, the present invention is not limited to this, and a plurality of kinds of activated carbons which are different in adsorption power may be disposed to be mixed in each of the high and low adsorptive layers. A substance other than activated carbon may be disposed, together with the activated carbon, in each of the high and low adsorptive layers. The present invention may be configured so that the average adsorption power of the activated carbon disposed in the highly adsorptive layer is stronger than the average adsorption power of the activated carbon disposed in the low adsorptive layer. In other words, the present invention may be configured so that the adsorption power of the highly adsorptive layer as a whole is stronger than that of the low adsorptive layer as a whole.

(2) In the canisters according to the first embodiment, Modified Examples 2 and 3 and second embodiment, a honeycomb adsorbent may be disposed between the third chamber and the atmosphere port, in a similar manner as in Modified Example 1. That is, another space may be provided between the third space and the atmosphere port to dispose the honeycomb adsorbent in this space. At this time, the end part on the atmosphere side of the third space is brought in a state where it is connected to the external space via the space in which the honeycomb adsorbent is disposed and the atmosphere port.

(3) The component corresponding to the third chamber in the canisters according to the first embodiment, Modified Examples 1 to 3 and second embodiment may be distributed solely as an evaporated fuel treatment device on the market.

(4) The canisters of Modified Examples 1 to 3 of the first embodiment may be configured so that the first and second chambers and the third chamber are separated from each other, as with the second embodiment.

(5) Also in the first and second chambers in the canisters according to the first embodiment, Modified Examples 1 and 2 and second embodiment, activated carbon may be disposed in the first space of the first chamber and/or in the second space of the second chamber in a state where the spaces have a plurality of layers, as with Modified Example 3.

(6) A material, other than activated carbon, which can adsorb and desorb the evaporated fuel may also be disposed in the first and second spaces in the canisters according to the first embodiment, Modified Examples 1 to 3 and second embodiment. Specifically, for example, activated carbon molded into a pellet form may be disposed.

[Correspondence with Claims]

The correspondence between the terms used in the above explanation about the embodiments and the terms used in the claims is indicated.

In the canisters according to the first embodiment, Modified Examples 1 to 3 and second embodiment, the third chamber corresponds to one example of the evaporated fuel treatment device. The activated carbon disposed in the first space corresponds to one example of the first adsorbent material. The activated carbon disposed in the second space corresponds to one example of the second adsorbent material.

The invention claimed is:

1. An evaporated fuel treatment device which is provided in a canister, wherein the canister comprises: an inflow port; an outflow port; and an atmosphere port, the canister accumulating fuel vapor flowing in from a fuel tank via the inflow port and causing the accumulated fuel vapor to flow out to an internal combustion engine via the outflow port by air flowing in from the atmosphere port, wherein the canister further comprises:

a first chamber having a first space which has disposed therein a first adsorbent material that is an adsorbent material for adsorbing the fuel vapor, the first chamber having a first end and a second end; a second chamber having a second space which- has disposed therein a second adsorbent material that is the adsorbent material, the second chamber having a first end and a second end; and a communication passage connecting the first space to the second space at the first end of the first chamber and at the first end of the second chamber, wherein the inflow port and the outflow port are provided in the second end of the first chamber, the inflow port and the outflow port connecting the first space to an external space, wherein the evaporated fuel treatment device is configured as a third chamber having a third space which has disposed therein activated carbon for adsorbing the fuel vapor, the third chamber having a first end and a second end, wherein the second space is connected to the third space via the first end of the third chamber and the second end of the second chamber, wherein the atmosphere port is provided in the second end of the third chamber, the atmosphere port connecting the third space to the external space, wherein the third space is provided with a highly adsorptive layer and a low adsorptive layer which are aligned from the first end of the third chamber to the second end of the third chamber, the highly adsorptive layer and the low adsorptive layer each having the activated carbon disposed therein, wherein the third space is in a columnar or polygonal prism shape, has a constant width and is slenderer in width than the second space is, wherein the highly adsorptive layer has stronger power for adsorbing the fuel vapor than that of the low adsorptive layer, and is positioned closer to the first end of the third chamber than the low adsorptive layer is, wherein the activated carbon disposed in the highly adsorptive layer has a larger adsorption capacity than an adsorption capacity of the activated carbon disposed in the low adsorptive layer, and wherein a length of the highly adsorptive layer in a direction from the first end of the third chamber to the second end of the third chamber is shorter than a length of the low adsorptive layer in the direction.

2. The evaporated fuel treatment device according to claim 1, wherein, in the third space, a honeycomb adsorbent which is a cylindrical member with a honeycomb structure that can adsorb and desorb the fuel vapor is further disposed closer to the second end of the third chamber than the low adsorptive layer is.

3. The evaporated fuel treatment device according to claim 1, wherein the activated carbon disposed in the highly adsorptive layer has a larger butane working capacity (BWC) than the activated carbon disposed in the low adsorptive layer does.

4. The evaporated fuel treatment device according to claim 2, wherein the activated carbon disposed in the highly adsorptive layer has a larger butane working capacity (BWC) than the activated carbon disposed in the low adsorptive layer does.

5. The evaporated fuel treatment device according to claim 1, wherein respective lengths of the highly adsorptive layer and the low adsorptive layer in the direction from the first end of the third chamber to the second end of the third chamber are referred to as L and respective widths of the highly adsorptive layer and the low adsorptive layer are referred to as D, wherein L/D of at least one of the highly adsorptive layer or the low adsorptive layer is less than 1.

6. The evaporated fuel treatment device according to claim 2, wherein respective lengths of the highly adsorptive layer and the low adsorptive layer in the direction from the first end of the third chamber to the second end of the third chamber are referred to as L and respective widths of the highly adsorptive layer and the low adsorptive layer are referred to as D, wherein L/D of at least one of the highly adsorptive layer or the low adsorptive layer is less than 1.

7. The evaporated fuel treatment device according to claim 3, wherein respective lengths of the highly adsorptive layer and the low adsorptive layer in the direction from the first end of the third chamber to the second end of the third chamber are referred to as L and respective widths of the highly adsorptive layer and the low adsorptive layer are referred to as D, wherein L/D of at least one of the highly adsorptive layer or the low adsorptive layer is less than 1.

8. The evaporated fuel treatment device according to claim 4, wherein respective lengths of the highly adsorptive layer and the low adsorptive layer in the direction from the first end of the third chamber to the second end of the third chamber are referred to as L and respective widths of the highly adsorptive layer and the low adsorptive layer are referred to as D, wherein L/D of at least one of the highly adsorptive layer or the low adsorptive layer is less than 1.

9. The evaporated fuel treatment device according to claim 1, wherein the adsorption capacity of the highly adsorptive layer is one of 17 g/dL, 15 g/dL, 11 g/dL or 9 g/dL and the adsorption capacity of the low adsorptive layer is one of 15 g/dL, 11 g/dL, 9 g/dL or 7 g/dL.

10. The evaporated fuel treatment device according to claim 2, wherein the adsorption capacities of the highly adsorptive layer is one of 17 g/dL, 15 g/dL, 11 g/dL or 9 g/dL and the adsorption capacity of the low adsorptive layer is one of 15 g/dL, 11 g/dL, 9 g/dL or 7 g/dL.

11. The evaporated fuel treatment device according to claim 3, wherein the adsorption capacities of the highly adsorptive are 17 g/dL, 15 g/dL, 11 g/dL or 9 g/dL and the adsorption capacity of the low adsorptive layer is one of 15 g/dL, 11 g/dL, 9 g/dL or 7 g/dL.

12. The evaporated fuel treatment device according to claim 4, wherein the adsorption capacities of the highly adsorptive layer are 17 g/dL, 15 g/dL, 11 g/dL or 9 g/dL and the adsorption capacity of the low adsorptive layer is one of 15 g/dL, 11 g/dL, 9 g/dL or 7 g/dL.

* * * * *